US006494571B1

(12) United States Patent
Finkel

(10) Patent No.: US 6,494,571 B1
(45) Date of Patent: Dec. 17, 2002

(54) PRINTING MEDIUM HAVING SEPARABLE MARGINAL AREAS AND METHOD OF PRINTING SAME

(75) Inventor: Evan Finkel, Los Angeles, CA (US)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/566,900

(22) Filed: May 9, 2000

(51) Int. Cl.[7] ..... B41J 3/407

(52) U.S. Cl. ..... 347/106; 347/105

(58) Field of Search ..... 347/106, 105; 358/1.18; 400/621; 283/81, 101, 105; 428/42; 83/861, 880, 881; 493/355, 404

(56) References Cited

U.S. PATENT DOCUMENTS

| | | | | |
|---|---|---|---|---|
| 1,771,983 A | | 1/1930 | Wandel | |
| 3,440,747 A | | 4/1969 | Oliver | |
| 3,565,463 A | | 2/1971 | Taylor | |
| 3,664,912 A | | 5/1972 | Olson | |
| 3,995,555 A | | 12/1976 | Stewart | |
| 4,174,857 A | | 11/1979 | Koza | |
| 4,177,730 A | | 12/1979 | Schriber et al. | |
| 4,220,272 A | | 9/1980 | Danti | |
| 4,298,647 A | | 11/1981 | Cancio et al. | |
| 4,324,823 A | | 4/1982 | Ray, III | |
| 4,617,215 A | | 10/1986 | Telesco | |
| 5,029,506 A | | 7/1991 | Glendening | |
| 5,198,275 A | | 3/1993 | Klein | |
| 5,346,321 A | | 9/1994 | Eudy | |
| 5,423,732 A | | 6/1995 | Coe | |
| 5,466,520 A | | 11/1995 | Krallmann et al. | |
| 5,484,167 A | | 1/1996 | Donaldson et al. | |
| 5,509,694 A | * | 4/1996 | Laurash et al. | 283/101 |
| 5,536,546 A | | 7/1996 | Nash | |
| 5,571,587 A | | 11/1996 | Bishop et al. | |
| 5,573,825 A | | 11/1996 | Brewster | |
| 5,631,053 A | | 5/1997 | Anderson et al. | |
| 5,825,996 A | | 10/1998 | Davis | |
| 5,853,837 A | | 12/1998 | Popat | |
| 6,173,649 B1 | * | 1/2001 | Onishi | 101/483 |

FOREIGN PATENT DOCUMENTS

| | | |
|---|---|---|
| EP | 1 057 630 A2 | 12/2000 |
| GB | 2 048 817 A | 12/1980 |
| JP | 5-341716 | 12/1993 |
| JP | 7-195880 | 8/1995 |
| JP | P7-306641 | 11/1995 |
| WO | 98/20447 | 5/1998 |

OTHER PUBLICATIONS

Epson Photo Stickers, A6 S041144, May, 1998.
Epson Ink Jet Transparencies, Letter S041064, Oct., 1995.
Epson Iron–On Cool Peel Transfer Paper, Letter S041153, Dec., 1996.
Paper Catalog, Exhibit A1, pp. 1 and 31–69.
Card Stock, Exhibit A2, #BC1355.
Inao Multi–card name, card size.
MJ–700V2C Reference Guide.
Canon, Color Bubble Jet Printer BJC–35v II Print Guide.
Command Manual for Macintosh (Ichitaro Ver.5).
Sample, Paper Studio Paper Edge, Printing medium.

* cited by examiner

*Primary Examiner*—John Barlow
*Assistant Examiner*—Manish S. Shah
(74) *Attorney, Agent, or Firm*—Sughrue Mion, PLLC

(57) ABSTRACT

A printing medium for use in a printing system such as a personal printing which includes a substrate having an outer periphery; and perforations or perforated lines spaced inwardly from part of the outer periphery in, for example, a U-shape so as to define separable marginal areas outside the perforations, and so as to define a primary printable area inside the perforations. The perforations extend to an edge the printing medium such that the defined primary printable area also extends to the same edge of the printing medium. A graphical image is printed on the printing medium in the primary printable area and extending into part of the separable marginal areas.

46 Claims, 9 Drawing Sheets

PRINTING MEDIUM HAVING SEPARABLE MARGINAL AREAS AND METHOD OF PRINTING SAME

BACKGROUND OF THE INVENTION

1. Field of the Invention

The present invention relates generally to a printing medium having separable marginal areas and a primary printable area intended for use with a conventional printer, such as an inkjet or laser printer; and a method of printing an image on the printing medium using the conventional printer. The printing medium and method of printing in accordance with the present invention is particularly applicable for the creation of finished printed products such as personal greeting cards, invitations, announcements, photo-type prints, and the like using conventional printers to achieve a professional finish look.

2. Background of the Invention

The advancement made in image forming technology has been considerable in recent years. In particular, the improvement in the quality of images using today's printers, including inkjet and laser printers, has created a demand for the ability to create affordable personal printed products such as greeting cards, invitations, announcements, photo-type prints, and the like that are comparable in quality to those made by professional printing companies.

To meet this growing demand, companies have developed paper products of high quality for use with inkjet and/or laser printers. Also, in connection with the development of these high quality paper products, companies have marketed software for selecting and printing various images onto these paper products. For example, many companies now offer a large selection of greeting card graphic images for every occasion which are stored on computer diskettes or CDROMs, or which are increasingly being made available for downloading from the Internet, and which are adapted to be used with a conventional desktop publishing program to create high quality personalized greeting cards.

However, one problem encountered when printing using conventional inkjet and/or laser printers is that, for any given size printing medium, these printers require marginal areas on sides of the printing medium to transport the printing medium through the printer. That is, these printers are not capable of printing from edge-to-edge on the printing medium. For example, widely used conventional inkjet printers require a non-print region at the leading edge, the side edges and the rear edge of the printing medium. These non-print regions are necessary to grip and transport the printing medium inside of the printer.

Furthermore, depending on the printer, the size of the non-print regions of the leading edge and the rear edge may be different, thereby offsetting the print region from the central part of the printing medium which reduces the overall quality of an image printed thereon. On the other hand, if the size of non-print region produced at the leading edge of the printing medium is set to be the same as the size of the non-print region produced at the trailing edge so that the print region can be centered from top to bottom on the printing medium, a very large non-print region is required at both the leading and trailing edges.

Therefore, since conventional printers are incapable of printing from edge-to-edge on the printing medium, personal greeting cards, invitations, announcements, photo-type prints, and the like using conventional desktop printing systems have margins at the edges of the finished printed output. Such margins, which may be unequal as explained above, result in a finished look which is inferior to that of similar professionally printed products.

FIGS. 1*a* and 1*b* illustrate an example of the foregoing problem in the case of a greeting card. These figures show a conventional printing medium 1 having a graphical image 3 printed within side margins 4 on the front panel on one side of the printing medium, and a greeting 5 (e.g., "Happy Birthday") printed on the greeting panel on the other side of the printing medium. The printing medium further includes a score line 2 along which the printing medium can be folded to obtain a folded greeting card as shown in FIG. 2.

FIG. 3 illustrates an example of the foregoing problem in the case of a photo-type print or postcard. In particular, FIG. 3 shows a conventional printing medium 6 used to print a high quality image 7 similar to a photograph. As evident from the illustration, although the quality of the printed image itself may be very good, the overall appearance of the image on the printing medium is inferior to that of an actual photograph or professionally printed postcard because it is not possible to set the size of the leading non-print margin 8 having a dimension $d_1$ equal to that of the trailing non-print margin 9 having a dimension $d_2$ due to the transport mechanisms in most conventional printers. Accordingly, the overall layout of the image 7 is not proportional (i.e., not centered from left to right) with respect to the printing medium. In order to alter the margins so that they are proportional, or in order to remove the margins altogether, the printing medium must be manually cut.

To overcome the foregoing shortcomings, U.S. application Ser. No. 08/946,222, which is hereby incorporated herein by reference in its entirety, discloses a printing medium 10 as shown in FIG. 4 having perforations 11 which define separable portions (or marginal areas) 12 outwardly therefrom along a peripheral part of the printing medium, and which define a primary printing area 13 enclosed inwardly therefrom. The printing medium can be manufactured with the perforations formed at different distances from the edges of the printing medium accounting, for example, for the difference between the leading and trailing edge margins required to properly transport the printing medium through a printer. That is, as shown in FIG. 4, the primary printing area can be positioned off-center with respect to the printing medium 10. Accordingly, an image 14 can easily be printed on the printing medium such that the edges of the printed image is centered with respect to the primary printing area, and such that, upon removal of the separable portions after printing, the resulting finished printed output has a well balanced appearance.

Furthermore, in one particular embodiment, U.S. application 08/946,222 discloses the so-called "bleed printing" or "full bleed printing" technique in combination with the perforated printing medium to achieve a finished printed product having a professional quality look similar to that, for example, of an actual photograph. In this embodiment, as shown in FIG. 5, the image 15 is printed such that the actual print area extends some distance beyond the perforations 11 and into the separable portions 12. Upon removal of the separable portions after printing, the resulting finished printed output extends completely to the edge of the finished product.

One example of a commercially available printing medium which incorporates the invention disclosed in U.S. application Ser. No. 08/946,222 is PAPERSTUDIOS'

PAPEREDGE GRC170G1CC01-JP printing medium. This printing medium also has a perforated line defining outwardly therefrom a continuous outer portion or margin along the entire periphery of the printing medium, and defining inwardly therefrom a primary printable area. A user of the PAPERSTUDIOS' printing medium may connect to the company's Internet web site and download images which are formatted to print beyond the perforations and into the continuous margin along the entire periphery of the printing medium using conventional software application programs such as MICROSOFT WORD.

SUMMARY OF THE INVENTION

The present invention provides a novel and non-obvious improvement upon the printing medium and method of printing an image thereon disclosed in U.S. application Ser. No. 08/946,222. In particular, an object of the present invention is to provide a printing medium for use in the creation of a finished printed product such as personal greeting cards, invitations, announcements, photo-type prints, and the like using conventional printers; and that have a professional finish look while maintaining at least part of one edge of the original printing medium in the finished printed product.

Accordingly, the present invention provides a printing medium for use in a printing system such as a personal printing which includes a substrate having an outer periphery; and perforations or perforated lines spaced inwardly from part of the outer periphery in, for example, a U-shape so as to define separable marginal areas outside the perforations, and so as to define a primary printable area inside the perforations. The perforations extend to an edge the printing medium such that the defined primary printable area also extends to the same edge of the printing medium.

The present invention also provides a method of making a finished printed output having graphical content printed to an edge of the finished printed output. The method includes the step of providing a print medium having separating portions or a perforated line spaced inwardly from part of the outer periphery of the print medium so as to define separable marginal areas outside the perforated line, and so as to define a primary printable area inside the perforated line, and extending to an edge of the printing medium. The method further includes the step of loading the print medium into a printer, printing a graphical image on the one side of the print medium so that an edge of the primary printable area, upon removing the separable marginal areas, has at least a portion of the graphical image printed thereat, and manually removing the separable marginal areas so that the remaining portion of the print medium becomes the finished printed output having at least the portion of the graphical image extending completely to an edge of the finished printed output.

Accordingly, an advantage of the present invention is that, by maintaining an edge of the printing medium in the final finished printed product, the number of separable marginal areas can be reduced, thereby making it simpler for the user to create the finished product. Additionally, since the perforated line extends to an edge of the printing medium, the user will find it easier to begin the separation of the marginal areas. Furthermore, by maintaining an edge of the printing medium in the final finished product, the finished product will have at least one smooth edge which is precut by the manufacturer.

Moreover, printing mediums having non-continuous perforations in accordance with the present invention are relatively less expensive to manufacture then printing mediums having continuous perforations, since the conventional printing mediums require additional perforations.

DETAILED DESCRIPTION OF THE PREFERRED EMBODIMENTS

A printing medium in accordance with the present invention will be described with reference to FIGS. 6 and 7.

Figure 1A:
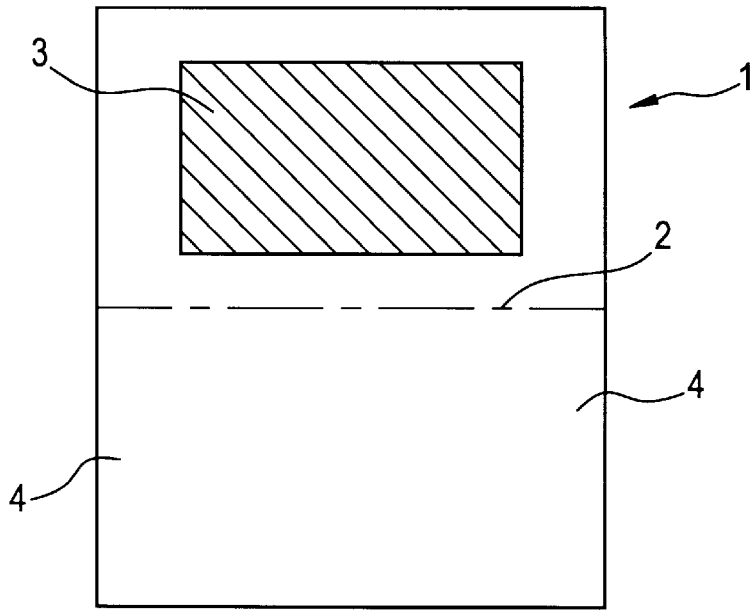
FIG. 1a PRIOR ART
FIGS. 1*a* and 1*b* are plan views of a conventional printing medium having a graphical image printed thereon.
Figure 1B:
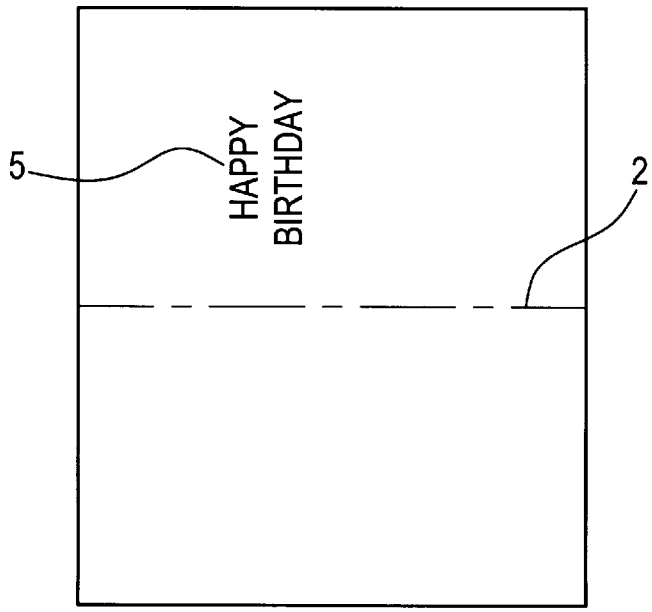
FIG. 1b PRIOR ART
Figure 2:
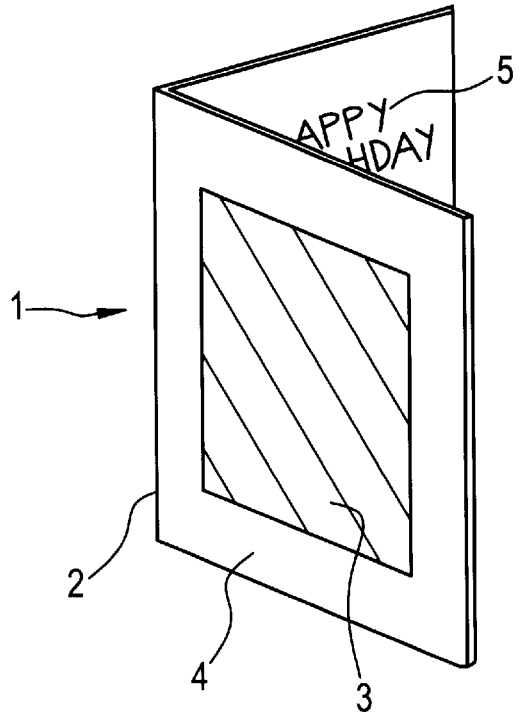
FIG. 2 PRIOR ART
FIG. 2 is a perspective view of the conventional printing medium of FIGS. 1*a* and 1*b* when folded.
Figure 3:
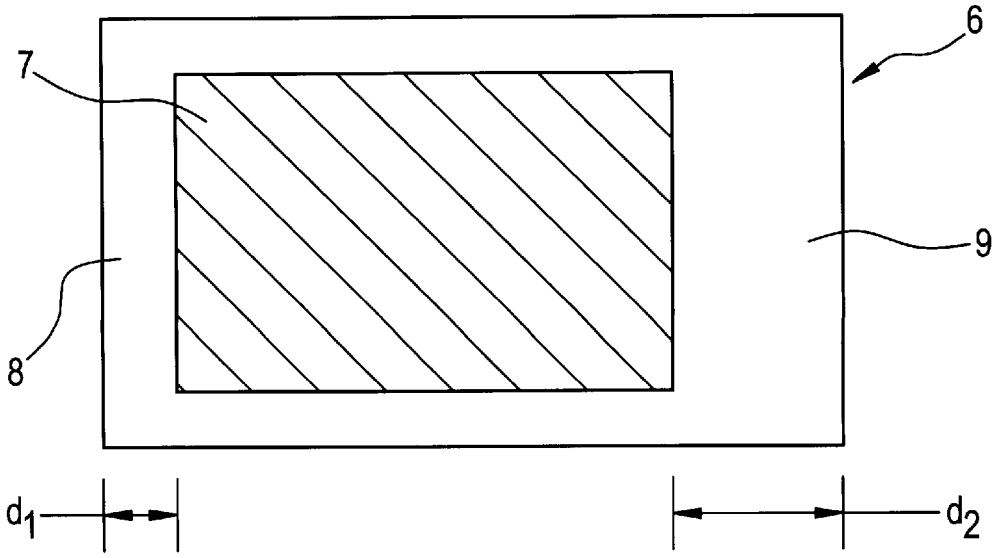
FIG. 3 PRIOR ART
FIG. 3 is a plan view of a conventional printing medium used to print a high quality image similar to a photograph or a postcard.
Figure 5:
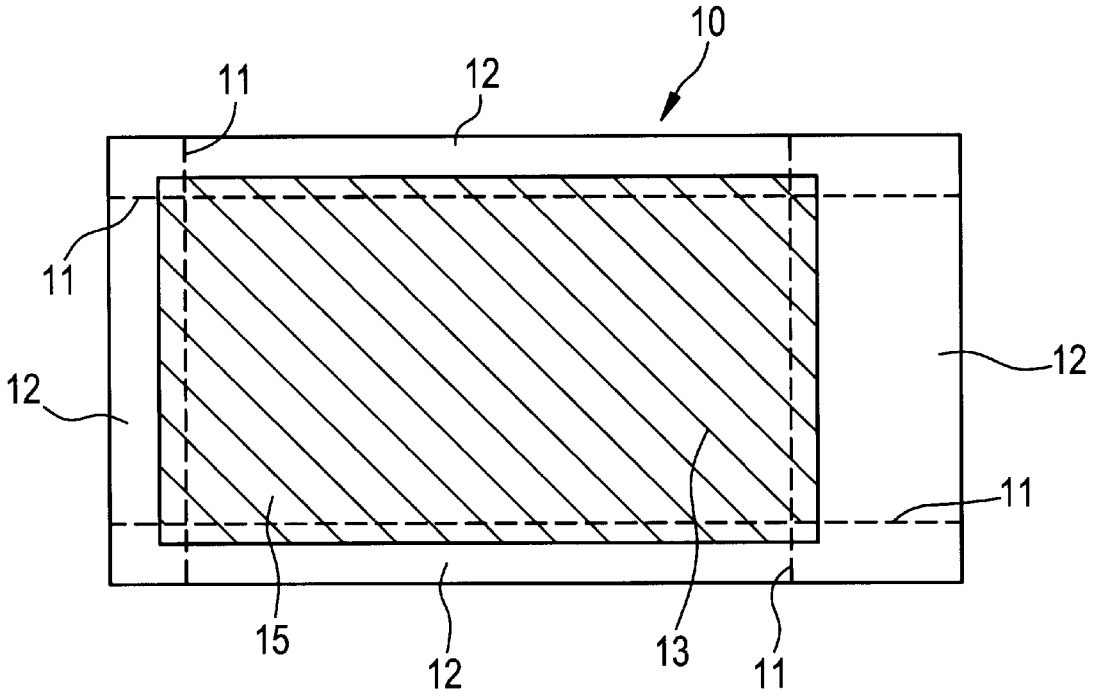
FIG. 5 is another plan view of a printing medium having perforations which define separable portions outwardly therefrom along a peripheral part of the printing medium, and which define a primary printing area enclosed inwardly therefrom.
Figure 4:
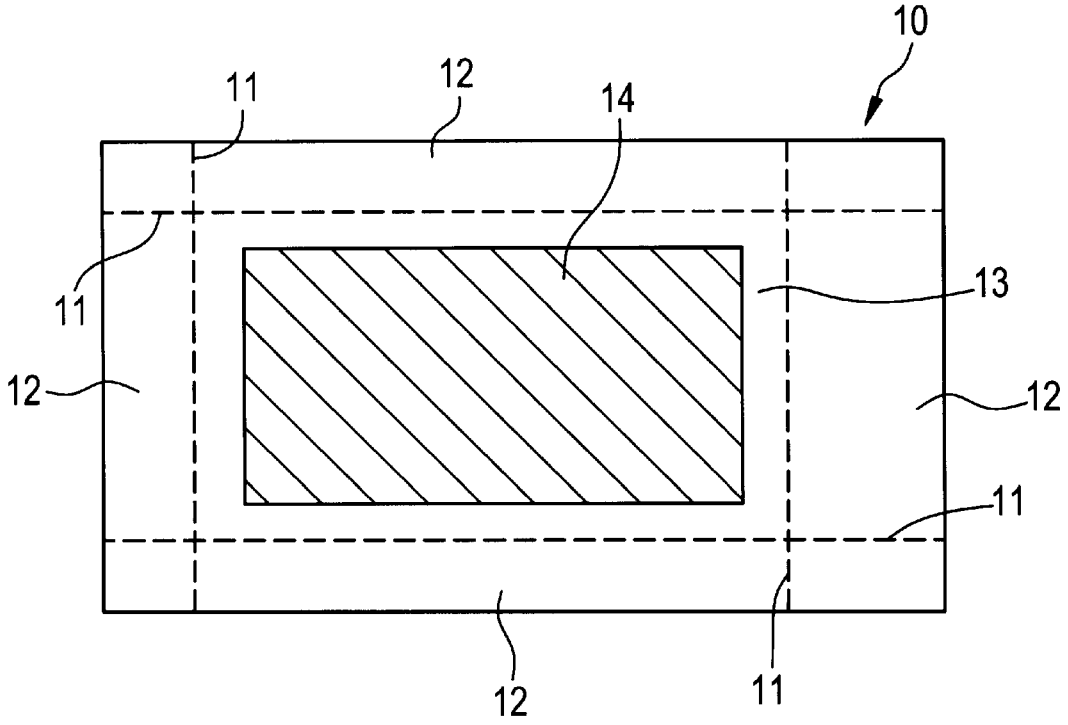
FIG. 4 is a plan view of a printing medium having perforations which define separable portions outwardly therefrom along a peripheral part of the printing medium, and which define a primary printing area enclosed inwardly therefrom.
Figure 6:
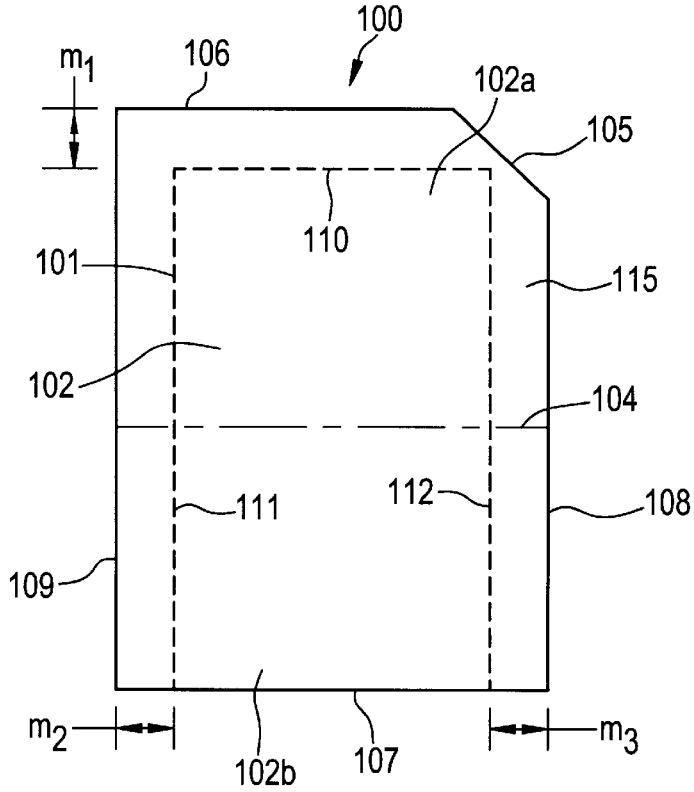
FIG. 6 is a plan view showing one side of a printing medium in accordance with the present invention.

The preferred embodiment of the printing medium 100 is shown in FIG. 6 comprising a non-continuous perforated line (or set of perforated lines) 101 having ends extending to an edge of the printing medium so as to define an outer marginal area along three sides of the printing medium. FIG. 7 shows the reverse side of the printing medium in FIG. 6.

More particularly, in the preferred embodiment illustrated in FIG. 6, the noncontinuous perforated line is a U-shaped perforation having its bottom portion 110 (i.e., the closed end of the U-shaped perforation) spaced inwardly from a first edge 106 at an outer periphery of the printing medium by a predetermined marginal distance ml, one leg 111 of the U-shaped perforation spaced inwardly from a second edge 109 at an outer periphery of the printing medium by a predetermined marginal distance $m_2$, and the other leg 112 of the U-shaped perforation spaced inwardly from a third edge 108 at an outer periphery of the printing medium by a predetermined marginal distance $m_3$. Furthermore, as shown in FIG. 6, each leg 111, 112 of the U-shaped perforation extends to a fourth edge 107 of the printing medium opposite the first edge 106.

In FIG. 6, the predetermined marginal distances have the following relationships shown in equations (1) and (2):

$$m_2=m_3 \quad (1),$$

$$m_1>m_2 \text{ and } m_3 \quad (2).$$

However, the present invention is not limited to these relationships, and the predetermined distances $m_1$, $m_2$, and $m_3$ can be set to any desired value. In each case, the non-continuous perforated line defines outer marginal areas 115 and an inner primary printable area 102 extending in part to an edge of the printing medium 100. Furthermore, to permit the so-called "bleed printing", or printing across the perforated line 101, the predetermined distances $m_1$, $m_2$, and $m_3$ are set sufficiently inward from the respective edges of the printing medium 100 so that the marginal areas 115 will include a printable area (non-primary printable area) disposed between the primary printable area 102 and the perforated line 101. That is, for any given printer, the marginal areas 115 defined by the perforated line 101 are made sufficiently large so as to include the non-print area in which the printer is not capable of printing due, for example, to the printer's gripping rollers, and a print area in which the printer is capable of printing.

As one can understand from the foregoing description, the expression "primary printable area" used in the context of the present invention refers to the area remaining after separation of the marginal areas, and includes a portion of the printing medium which is nonprintable due to the limits of the printer used. That is, the primary printable area defines the shape and size of the finished printed product when separated from the marginal areas.

While the foregoing embodiment of a printing medium uses a perforated line, other separation means can be used as well. For example, scoring which does not fully penetrate the printing medium can be used to create weakened portions allowing easy separation of the marginal areas.

Figure 8:
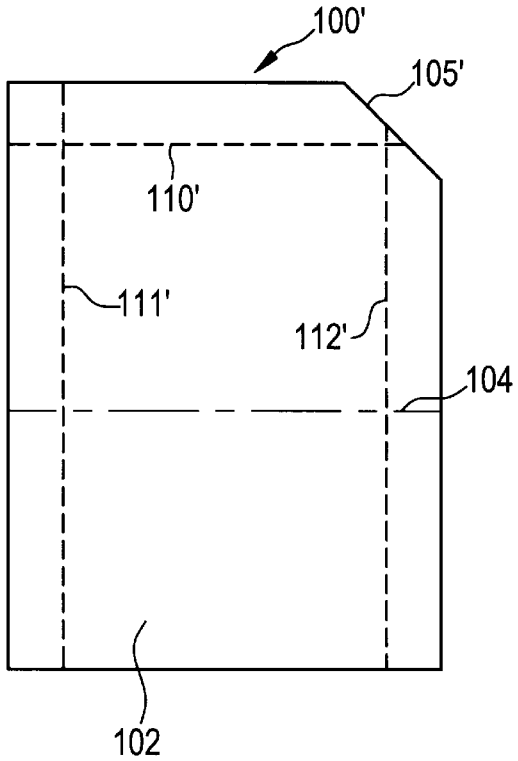
FIG. 8 is a plan view showing a printing medium in accordance with the present invention in which perforated lines extend to respective edges of the printing medium.

Additionally, while the foregoing embodiment of the printing medium shows the bottom perforation 110 and side perforations 111, 112 terminating where these perforations intersect, the present invention is not limited as such. As shown in FIG. 8, the perforations 110', 111', and 112' may each extend to respective edges of the printing medium while still defining the same primary printable area 102.

Figure 7:
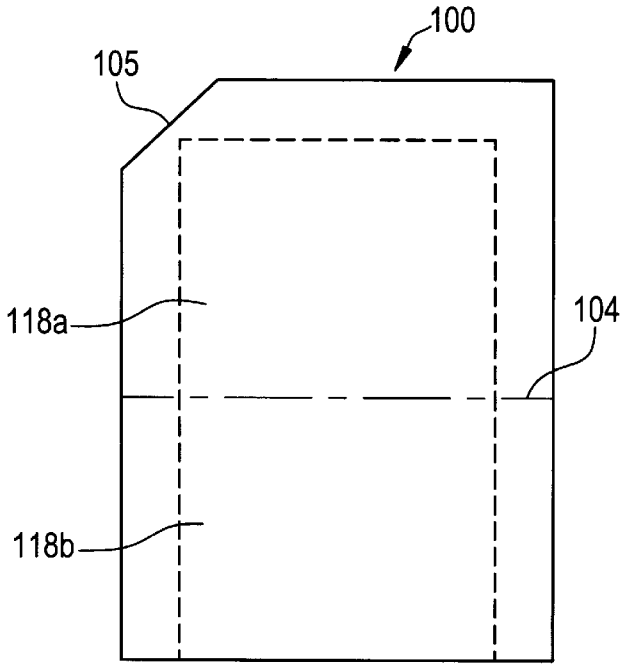
FIG. 7 is a plan view showing the other side of the printing medium of FIG. 6 in accordance with the present invention.

FIGS. 6 and 7 also illustrate another feature of the preferred embodiment of the present invention in which a score line 104 is made in the printing medium to allow easy folding of the printing medium after an image has been printed and the marginal areas removed so as to create a folded greeting card. In particular, as shown in FIGS. 6, the score line 104 crosses the primary printable area 102 along its width, thereby dividing this area into a front panel 102*a* of the greeting card having its top edge spaced apart from the first edge 106 of the printing medium, and a back panel 102*b* of the greeting card having as its bottom edge the fourth edge 107 of the printing medium.

As illustrated in FIG. 7, the reverse side of the front panel 102*a* becomes the inside panel 118*a* of the greeting card. Similarly, the reverse side of the back panel 102*b* becomes the greeting panel 118*b* of the greeting card. A description of the method of creating a greeting card in accordance with the present invention is provided further below with an explanation of how the different panels of the greeting card are used to create a finished product.

FIGS. 6 and 7 illustrate yet another feature of the preferred embodiment of the present invention in which the printing medium 100 has a notch 105 at one part of the printing medium (e.g., at a top corner of the printing medium) to indicate the correct orientation of the printing medium when inserting the printing medium into a printer. For example, if the printing medium has a glossy side for the front and back panels, and a non-glossy side for the inside and greeting panels, then the notch can be used to designate these sides based on the notch's position to the right or left of the printing medium. Of course, indicia other than a notch may be used for this purpose such as color coding a portion of the marginal areas, or placing written indicia in the marginal areas which describe the correct orientation.

Figure 9:
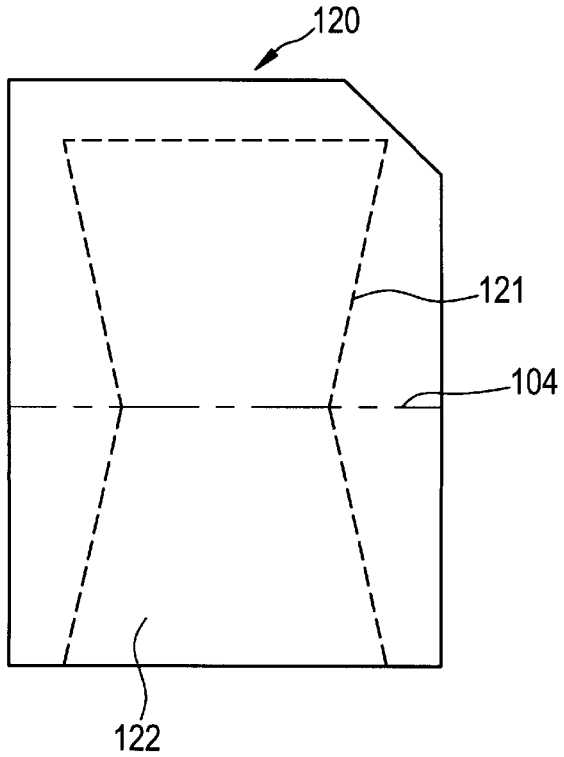
FIG. 9 is a plan view of a printing medium in accordance with the present invention having a butterfly-shaped primary printable area.

It should also be noted that while the preferred embodiment of a printing medium in accordance with the present invention as illustrated in FIGS. 6 and 7 involves a U-shaped perforation 101, the present invention is not limited as such, but also covers other suitable shapes in which one edge of the finished printed product is an edge of the original printing medium. For example, FIG. 9 illustrates a printing medium 120 having a non-continuous perforated line 121 defining a butterfly shaped primary printable area 122 and a score line 123 along which the primary printable area can be folded.

A printing method in accordance with the present invention, and a finished printed output using the printing method will now be described with reference to FIGS. 10 to 14.

Figure 10:
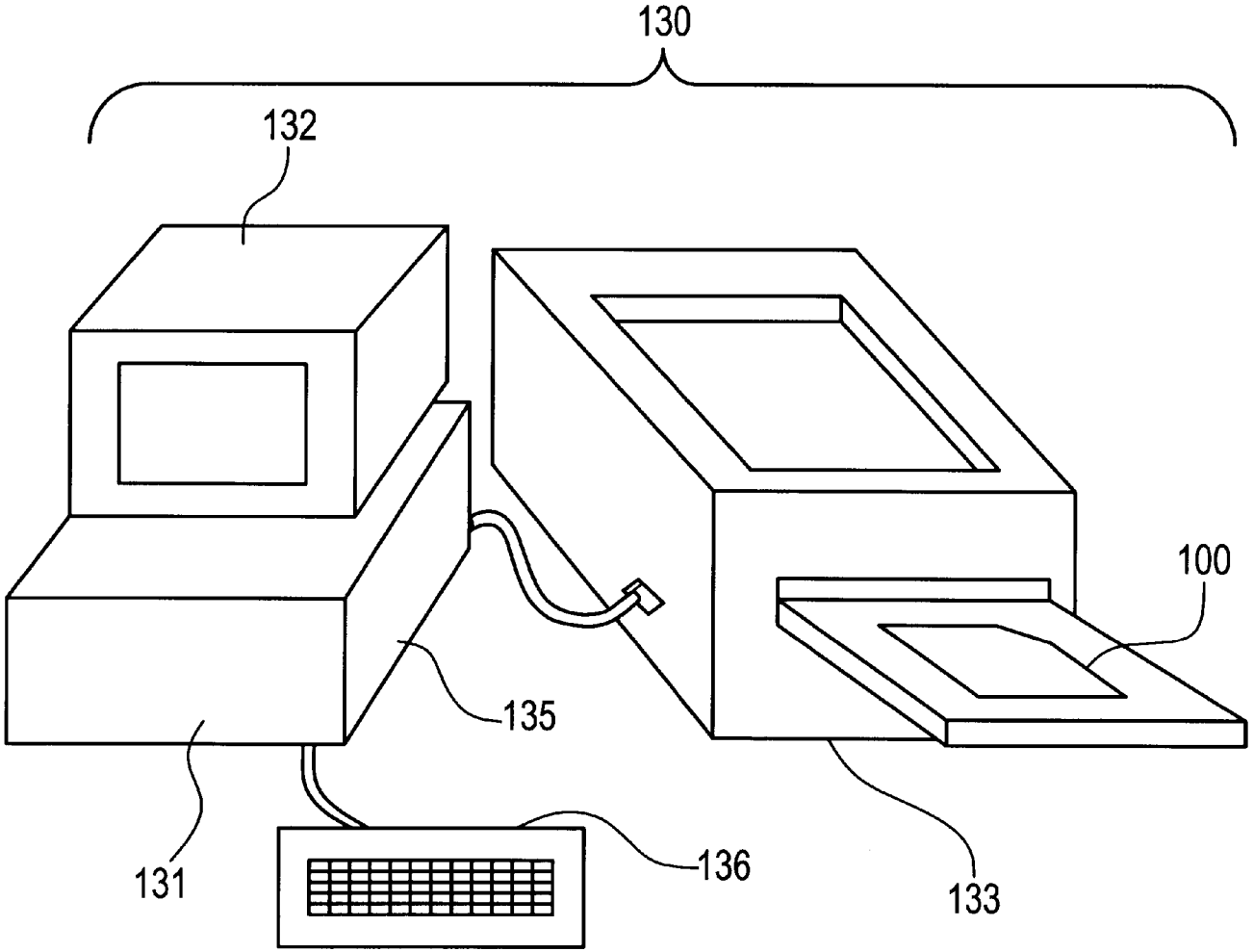
FIG. 10 is a perspective view showing a printing system in which the printing medium of FIG. 6 is loaded in a printer just prior to printing an image thereon.

FIG. 10 is a perspective view showing a printing system generally indicated by the reference numeral 130 having a personal computer 131, including a central processing unit, loaded with an operating system program and an application program 135 such as MICROSOFT WORD, an input device such as a keyboard 136, a monitor or display 132 connected to the personal computer, a printer 133 also connected to the personal computer, and the printing medium 100 loaded in the printer in the proper orientation so that an image can be printed on its top side (e.g., on the glossy side of the printing medium).

Figure 11:
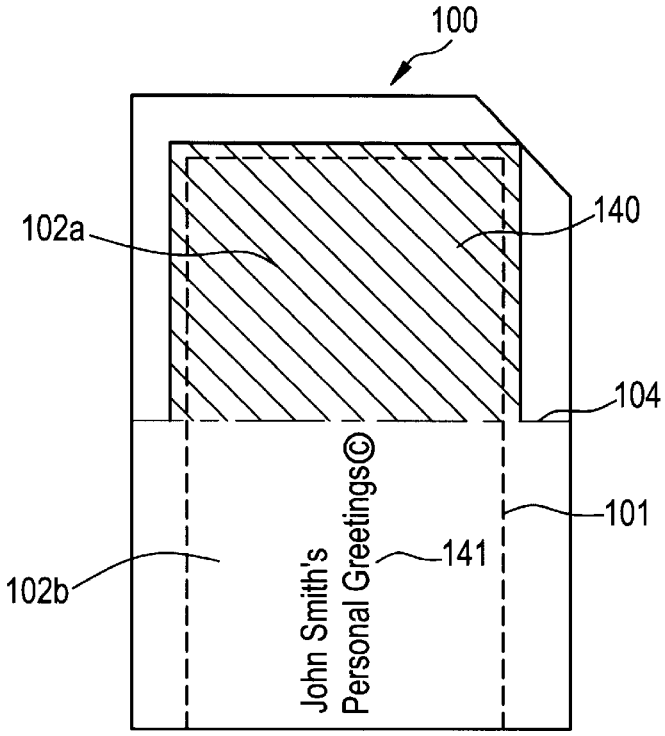
FIG. 11 is a plan view of the printing medium of FIG. 6 having an image printed thereon.

Referring to FIG. 11, a user can operate the printing system 130 to print a first image 140 onto the printing medium 100, and preferably on the front panel portion 102*a*, such that the first image extends across at least part of the perforated line 101 and into the marginal areas as shown in the figure. To achieve this result, the user can set the actual print area of the image to be larger than the primary printable area using the application program. Alternatively, the image can be preset by a vendor to have this size and made available to a purchaser of the printing medium through the internet or on a diskette or CDROM. The first image 140 can also be modified by the user, for example, to include his or her name or logo 141 on the back panel portion 102*b* of the printing medium.

Figure 12:
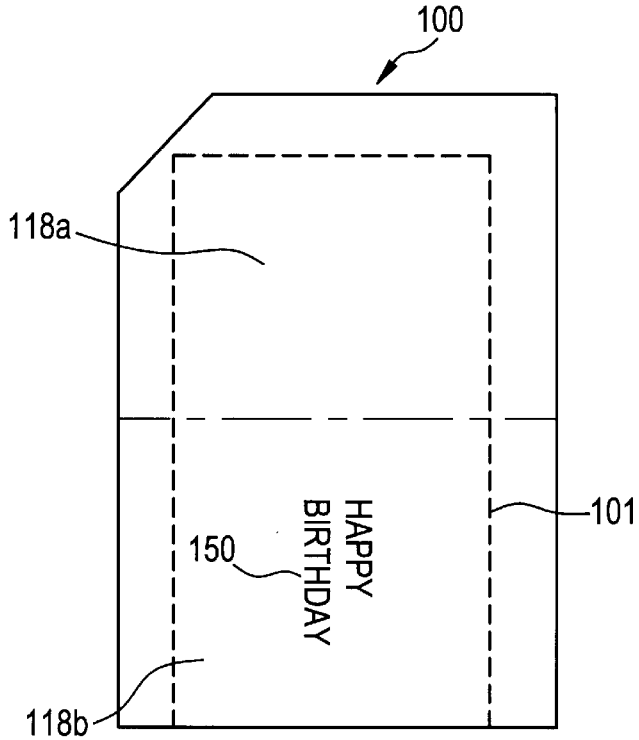
FIG. 12 is a plan view of the reverse side of the printing medium of FIG. 11 having another image printed thereon.

After printing the first image 140, the user removes the printing medium 100 from the printer and reloads the printing medium so that the reverse side will be printed (e.g., the non-glossy side of the printing medium) having the inside panel 118*a* and greeting panel 118*b*. Referring to FIG. 12, the user then prints a second image 150, such as the greeting "Happy Birthday," on the greeting panel 118*b*.

While the foregoing embodiment involves printing on one side of the printing medium, and removing and reloading the printing medium in the printer to print on the other side, an alternative embodiment contemplated by the present invention involves the use of a duplex printer which can print on both sides of a printing medium without requiring the user to remove and reload the printing medium. Duplex printers are becoming increasingly popular as their cost to consumers are driven down, and are well suited to carry out the double-sided printing needed to create greeting cards and the like using the printing medium of the present invention.

Figure 13:
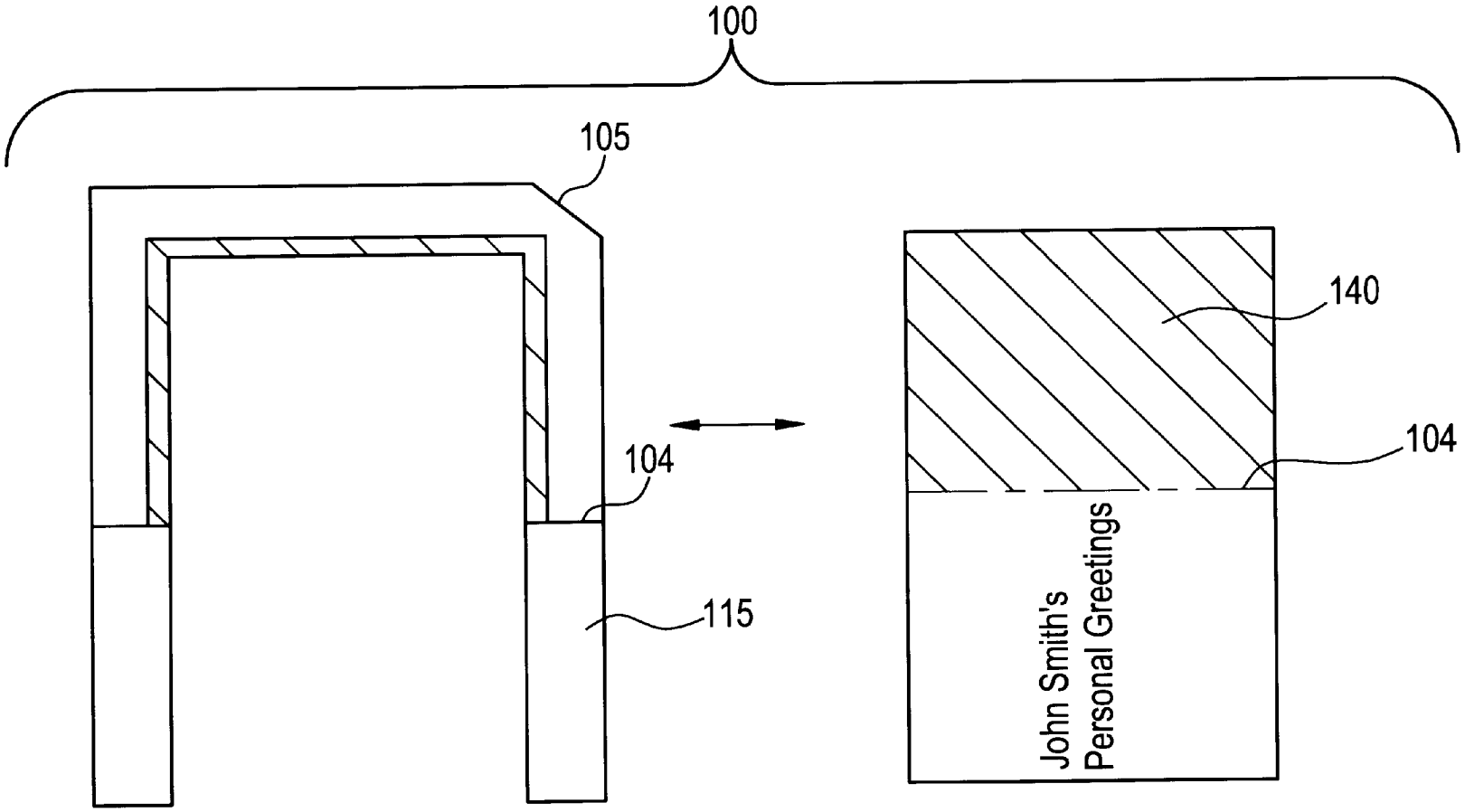
FIG. 13 is a plan view of the printing medium of FIG. 11 with the separable marginal areas shown separated from the primary printable area.
Figure 14:
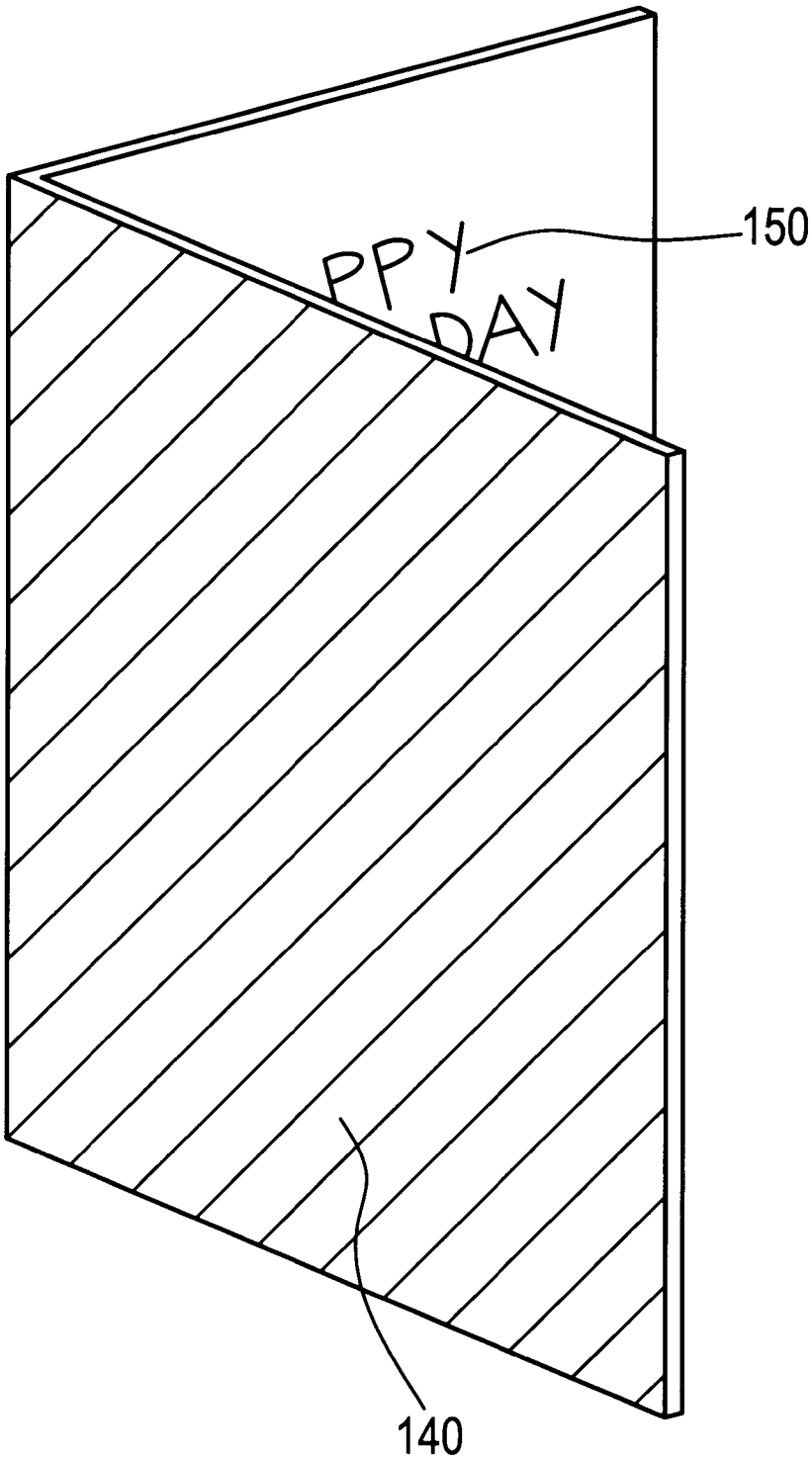
FIG. 14 is a perspective view of the printing medium of FIG. 11 with the separable marginal areas removed and the remaining primary printable area folded along a score line.

Having printed both the first and second images, the user then removes the printing medium from the printer and proceeds to separate the marginal areas from the three sides of the primary printable area as shown in FIG. 13. Finally, as shown in FIG. 14, the user folds the primary printable area along the score to obtain the finished product.

As evident from the foregoing description, by maintaining an edge of the printing medium in the final finished product, the number of separable marginal areas can be reduced, thereby making it simpler for the user to create a finished product. Additionally, since the perforated line extends to an edge of the printing medium, the user will find it easier to begin the separation of the marginal areas. Moreover, by maintaining an edge of the printing medium in the final finished product, the finished product will have at least one smooth edge which is precut by the manufacturer.

Printing mediums having non-continuous perforations in accordance with the present invention are also relatively less expensive to manufacture then printing mediums having continuous perforations, since the conventional printing mediums require additional perforations.

As evident from the foregoing description, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A printing medium for use in a printing system, comprising:

a substrate having an outer periphery; and separating portions spaced inwardly from part of said outer periphery so as to define separable marginal portions having separable marginal areas outside said separating portions, and so as to define a primary printable portion having a primary printable area inside said separating portions, said primary printable area extending to a first edge of the printing medium; and wherein said separating portions separate said separable marginal portions from said primary printable portion such that each of said separable marginal portions and said primary printable portion has a same cross-sectional thickness taken in a direction orthogonal to one side of the printing medium.

2. The printing medium according to claim 1, wherein said primary printable area is a continuous area void of perforations and cuts.

3. The printing medium according to claim 1, wherein said separating portions form a U-shape having an open end extending to the first edge of the printing medium, said U-shape defining said primary printable area.

4. The printing medium according to 3, wherein said primary printable area is rectangular and is greater than half an entire surface area of a same side of said printing medium.

5. The printing medium according to claim 4, further comprising a score line across said primary printable area.

6. The printing medium according to claim 1, wherein said primary printable area is greater than half an entire surface area of a same side of said printing medium.

7. The printing medium according to claim 1, wherein said substrate is adapted for use in an inkjet printer.

8. The printing medium according to claim 7, wherein said first edge is a trailing edge of said print medium with respect to a conveyance of said print medium by the inkjet printer.

9. The printing medium according to claim 1, wherein said printing medium is rectangular and said first edge is a shorter edge of the printing medium.

10. The printing medium according to claim 1, wherein said primary printable area includes an image printed thereon and extending across an edge of said primary printable area into at least one of said separable marginal areas.

11. A printing medium for use in a printing system, comprising:

a substrate having an outer periphery; and a perforated line spaced inwardly from a part of said outer periphery so as to define separable marginal portions having separable marginal areas outside said perforated line, and so as to define a primary printable portion having a primary printable area inside said perforated line, said primary printable area extending to a first edge of the printing medium and wherein said perforated line separates said separable marginal portions from said primary printable portion such that each of said separable marginal portions and said primary printable portion has a same cross-sectional thickness taken in a direction orthogonal to one side of the printing medium.

12. The printing medium according to claim 11, wherein said primary printable area is a continuous area void of perforations and cuts.

13. The printing medium according to claim 11, wherein said perforated line forms a U-shape having an open end extending to the first edge of the printing medium, said U-shape defining said primary printable area.

14. The printing medium according to 13, wherein said primary printable area is rectangular and is greater than half an entire surface area of a same side of said printing medium.

15. The printing medium according to claim 14, further comprising a score line across said primary printable area.

16. The printing medium according to claim 11, wherein said primary printable area is greater than half an entire surface area of a same side of said printing medium.

17. The printing medium according to claim 11, wherein said substrate is adapted for use in an inkjet printer.

18. The printing medium according to claim 11, further comprising instructional indicia disposed on a part of said separable marginal areas.

19. A print medium for use in a personal computer system which includes a printer to produce a printed output having at least a portion of a graphical image printed completely to an edge of the printed output, said print medium comprising a two-sided substrate to load in the printer of the personal computer system, said substrate having an outer periphery and a perforated line spaced inwardly from a part of said outer periphery so as to define separable marginal areas outside said perforated line, and so as to define a primary printable area inside said perforated line, said perforated line having ends extending to a first edge of said printing medium such that said primary printable area extends to said first edge of the printing medium, wherein said primary printable area and at least a portion of said separable marginal areas are located within said substrate to receive printing of the graphical image from the printer operated by the personal computer system in response to a user operating said personal computer system such that at least a portion of the graphical image is printed across the perforated line into at least part of both said primary printable area and said separable marginal areas; and wherein said first edge is a trailing edge of said print medium with respect to a conveyance of said print medium by the printer when receiving printing of the graphical image.

20. The printing medium according to claim 19, wherein said primary printable area is a continuous area void of perforations and cuts.

21. The printing medium according to claim 19, wherein said perforated line forms a U-shape having an open end extending to the first edge of the printing medium, said U-shape defining said primary printable area.

22. The printing medium according to 21, wherein said primary printable area is rectangular and is greater than half an entire surface area of a same side of said printing medium.

23. The printing medium according to claim 22, further comprising a score line across said primary printable area.

24. The printing medium according to claim 19, wherein said primary printable area is greater than half an entire surface area of a same side of said printing medium.

25. The print medium according to claim 19, further comprising instructional indicia disposed on at least one of said marginal areas for instructing a user on printing an image on said print medium with the personal computer system.

26. The print medium according to claim 19, wherein at least one side of said two-sided substrate has a glossy finish.

27. A method of making a finished printed output having graphical content printed to an edge of the finished printed output, said method comprising the steps of:

providing a print medium comprising, a substrate having an outer periphery; and separating portions spaced inwardly from part of said outer periphery so as to define separable marginal areas outside said separating portions, and so as to define a primary printable area inside said separating portions, said primary printable area extending to a first edge of the printing medium, the separable marginal areas adapted to be manually removed along the separating portions and discarded, thereby leaving only the primary printable area;

loading the print medium into a printer so that a first side of the print medium is in a print position, and so that said first edge is a trailing edge of said print medium with respect to a conveyance of said print medium by the printer;

printing with the printer a graphical image on the first side of the print medium so that an edge of the primary printable area, upon removing the separable marginal areas, has at least a portion of the graphical image printed thereat;

manually removing the print medium from the printer; and manually removing the separable marginal areas so that the remaining portion of the print medium becomes the finished printed output having at least the portion of the graphical image extending completely to an edge of the finished printed output.

28. The method as defined in claim 27, wherein said finished printed output is a greeting card.

29. The method as defined in claim 27, further comprising printing on the other side of the print medium; and wherein one of said printing steps is performed before the other of said printing steps such that the later performed printing step is performed after loading the print medium into the printer in changed orientation from the orientation of the print medium loaded for the earlier performed printing step.

30. The method as defined in claim 29, wherein said step of loading the print medium into the printer in changed orientation includes loading the print medium by manual operation of the user in response to the user having read instructional indicia disposed in part of the marginal areas of at least one side of the print medium.

31. The method of making a finished printed output in accordance with claim 27, wherein said step of printing with a printer is performed using an inkjet printer.

32. The method as defined in claim 27, wherein the printer is a duplex printer adapted to print on both sides of the printing medium without requiring removal of the printing medium from the duplex printer, and wherein said step of printing with the printer the graphical image on the first side of the print medium further includes the step of printing another graphical image on a second side of the print medium opposite the first side without removing the print medium from the duplex printer.

33. The method of making a finished printed output having graphical content printed to an edge of the finished printed output, said method comprising:

loading, by manual operation of a user of a personal computer system, a two-sided print medium having an outer periphery into a conventional desktop printer connected in the personal computer system, and wherein the print medium is loaded so that a first side of the print medium is in a print position, and further wherein the print medium has a perforated line spaced inwardly from part of said outer periphery so as to define separable marginal areas, which do not form part of the finished printed output, outside said perforated line, and so as to define a primary printable area inside said separating portions, said primary printable area extending to a first edge of the printing medium such that the primary printable area forms the finished printed output;

defining in the personal computer system in response to input from the user a printing area corresponding to the primary printable area;

selecting by operation of the personal computer system an actual printing area extending at least in part outside the primary printable area;

generating a user selected graphical image for printing in the primary printable area;

printing, with the printer in the personal computer system, the graphical image on the first side of the print medium such that at least a portion of the graphical image is printed continuously across the perforated line into both the primary printable area and a portion of the separable marginal areas of the first side of the print medium;

removing, by manual operation of the user, the print medium from the printer; and removing by manual operation of the user, the separable marginal areas so that the remaining portion of the print medium becomes the finished printed output having at least a portion of the graphical image extending completely to an edge of the finished printed output; and wherein said loading step includes loading the two-sided print medium so that said first edge is a trailing edge of said print medium with respect to a conveyance of said print medium by the printer.

34. The method as defined in claim 33, wherein said finished printed output is a greeting card.

35. An improved personal computer system of the type including a central processing unit, a memory connected to the central processing unit, an operating system program stored in the memory, a display responsive to control by the central processing unit, input means for providing input to the personal computer system, and a printer responsive to control by the central processing unit, wherein the improvement comprises:

a two-sided substrate having an outer periphery, and separating portions spaced inwardly from part of said outer periphery so as to define corresponding separable marginal areas on both sides of said substrate outside said separating portions, and so as to define corresponding primary printable areas on both sides of said substrate inside said separating portions, said primary printable areas extending to a first edge of the printing medium, the separable marginal areas adapted to be manually removed along the separating portions and discarded, thereby leaving only the primary printable areas; and an application program loaded in the memory, wherein said application program is compatible with the operating system program and wherein said application program includes:

means, responsive to input from a user using the input means, for providing an output having a first portion to be printed on one side of said substrate in said primary printable area thereof and having a second portion to be printed on the other side of said substrate in said primary printable area thereof;

means, responsive to input from the user using the input means, for actuating the printer at a first time (a) to print one of (1) said first portion of said output on said one side of said substrate such that part of said first portion is printed continuously across at least part of said separating portions and in said marginal areas of said one side and the remainder of said first portion is printed within said primary printable area of said one side and (2) said second portion of said output within at least said primary printable area of said other side of said substrate, and (b) to output said substrate from the printer: and means, responsive to input from the user using the input means, for actuating the printer at a second time to print the other of (1) said first portion of said output on said one side of said substrate such that part of said first portion is printed continuously across at least part of said perforated line and in said marginal areas of said one side and the remainder of said first portion is printed within said primary printable area of said one side and (2) said second portion of said output within at least said primary printable area of said other side of said substrate, after said substrate has been output from the printer and reloaded in changed orientation in the printer.

36. The improvement of claim 35, wherein said substrate has instructional indicia disposed thereon outwardly of said separating portions, said instructional indicia providing instructions for guiding the loading of said substrate in the printer.

37. An improved personal computer system of the type including a central processing unit, a memory connected to the central processing unit, an operating system program stored in the memory, a display responsive to control by the central processing unit, input means for a user to provide input to the personal computer system, and a printer responsive to control by the central processing unit, wherein the improvement comprises:

a two-sided substrate having an outer periphery; and separating portions spaced inwardly from part of said outer periphery so as to define separable marginal areas of said substrate outside said separating portions, and so as to define a primary printable area of said substrate inside said separating portions, said primary printable area extending to a first edge of the printing medium, the separable marginal areas adapted to be manually removed along the separating portions and discarded, thereby leaving only the primary printable areas such that the primary printable area is the area of a finished product of the personal computer system; and computer software loaded in the personal computer system, wherein said computer software is compatible with the operating system program and which computer software (i) allows a user of the personal computer system to define a printing area corresponding to the primary printable area on the substrate, (ii) selects an actual printing area larger extending, at least in part, outside the primary printable area on the substrate, (iii) allows the user of the personal computer system to generate a graphical image from at least one of graphic material stored within the computer software, graphic material stored within the memory of the computer, or graphic material created by the user of the personal computer system, and (iv) transmits data defining such graphical image to the printer such that the printer prints such graphical image primarily upon the primary printable area of the substrate but also over the separating portions and into at least a part of the marginal areas of the substrate.

38. A finished printed output made using a personal printing system having a printer, comprising:

a print medium having an outer periphery, and separating portions spaced inwardly from part of said outer periphery so as to define separable marginal areas of said substrate outside said separating portions, and so as to define a primary printable area of said substrate inside said separating portions; said primary printable area extending to a first edge of the printing medium; the separable marginal areas adapted to be manually removed along the separating portions and discarded, thereby leaving only the primary printable areas such that the primary printable area is the area of a finished product of the personal computer system; and a graphical image printed on a first side of the print medium so that an edge of the primary printable area, upon removing the separable marginal areas, has a portion of the graphical image printed thereat; and wherein said first edge is a trailing edge of said print medium with respect to a conveyance of said print medium by the printer when receiving printing of the graphical image.

39. The finished printed output according to claim 38, wherein said graphical image is printed on the first side of the print medium across the separating portions and into part of the separable marginal areas.

40. The finished printed output according to claim 38, wherein said separable marginal areas have been manually removed, leaving said primary printable area with said portion of the graphical image printed to an edge of said primary.

41. The finished printed output according to claim 38, wherein said print medium has instructional indicia on the separable marginal areas for instructing a user on making the finished printed output.

42. The finished printed output according to claim 41, wherein said instructional indicia provides instructions on how to orient said print medium in a printer.

43. The finished printed output according to claim 38, wherein perforations in said print medium form said separating portions.

44. The finished printed output according to claim 38, wherein said graphical image is printed on the first side of the print medium so that an entire peripheral edge of the primary printable area, upon removing the separable marginal areas, has a portion of the graphical image printed thereat.

45. The finished printed output according to claim 38, wherein said graphical image is printed using an inkjet printer.

46. A print medium for use in a personal computer system that includes a printer to produce a printed output having at least a portion of a graphical image printed completely to an edge of the printed output, said print medium comprising a two-sided substrate to load in the printer of the personal computer system, said substrate having an outer periphery and a perforated line spaced inwardly from a part of said outer periphery so as to define separable marginal areas outside said perforated line, and so as to define a primary printable area inside said perforated line, said perforated line having ends extending to a first edge of said print medium such that said primary printable area extends to said first edge of the print medium, wherein said primary printable area and at least a portion of said separable marginal areas are located within said substrate to receive printing of the graphical image from the printer operated by the personal computer system in response to a user operating said personal computer system such that at least a portion of the graphical image is printed across the perforated line into at least part of both said primary printable area and said separable marginal areas; and wherein said primary printable area is greater than half an entire surface area of a same side of said print medium.

* * * * *